US007039337B2

(12) United States Patent
Kawaguchi et al.

(10) Patent No.: US 7,039,337 B2
(45) Date of Patent: May 2, 2006

(54) IMAGE FORMING APPARATUS

(75) Inventors: Hiroshi Kawaguchi, Shizuoka (JP); Seiji Yokoyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 10/779,614

(22) Filed: Feb. 18, 2004

(65) Prior Publication Data

US 2004/0218944 A1 Nov. 4, 2004

(30) Foreign Application Priority Data

Feb. 21, 2003 (JP) ..... 2003-043723

(51) Int. Cl.
*G03G 15/00* (2006.01)
*G03G 15/16* (2006.01)

(52) U.S. Cl. ..... 399/90; 399/313

(58) Field of Classification Search ..... 399/121, 399/126, 313, 90, 88
See application file for complete search history.

(56) References Cited

U.S. PATENT DOCUMENTS 5,689,775 A * 11/1997 Marumoto ..... 399/121
6,256,472 B1 * 7/2001 Miyake et al. ..... 399/313
6,522,845 B1 2/2003 Sameshima ..... 399/88
2004/0013452 A1 * 1/2004 Choi ..... 399/313

FOREIGN PATENT DOCUMENTS

JP 58126544 A * 7/1983
JP 63173078 A * 7/1988
JP 03144474 A * 6/1991
JP 04016882 A * 1/1992
JP 05027614 A * 2/1993
JP 9-319174 12/1997
JP 11-161038 6/1999

* cited by examiner

*Primary Examiner*—Susan Lee
(74) *Attorney, Agent, or Firm*—Fitzpatrick, Cella, Harper & Scinto

(57) ABSTRACT

The invention provides an image forming apparatus including an image bearing member, a transfer member for transferring a toner image from the image bearing member, and a first contact portion and a second contact portion which can be mutually contacted for applying a voltage to the transfer member, the first contact portion having a convex portion, wherein the transfer member is pressed toward the image bearing member by a pressure exerted between the first contact portion and the second contact portion, and the convex portion has a hardness larger than that of the second contact portion. It is rendered possible to prevent an intrusion of toner or the like into the electrical contact portion, thus resulting in a contact failure.

30 Claims, 13 Drawing Sheets

IMAGE FORMING APPARATUS

BACKGROUND OF THE INVENTION

1. Field of the Invention

The present invention relates to an image forming apparatus of electrophotographic process or electrostatic recording process such as a copying apparatus or a printer.

2. Related Background Art

In a prior image forming apparatus such as a copying machine, a printer or a facsimile, there is known a color image forming apparatus employing, for the purpose of reducing the dimension of the entire apparatus, a method of transferring a toner image, formed for example by an electrophotographic process on an image bearing member, onto an intermediate transfer member and transferring the toner image, transferred to the intermediate transfer member, onto a transfer material.

FIG. 9 is a view showing a configuration of an image forming unit of a color image forming apparatus provided with an intermediate transfer member which is a background technology of the present invention. As shown in FIG. 9, an intermediate transfer belt unit 31 is provided with an intermediate transfer belt 30 constituting an intermediate transfer member, and is detachably mounted in a main body of an unrepresented image forming apparatus. The intermediate transfer belt unit 31 can be detached by opening a unit replacement door provided in the main body of the unrepresented image forming apparatus, and by extracting the unit in a direction indicated by an arrow a.

The intermediate transfer belt 30 is supported by a drive roller 100, a tension roller 105 and a secondary transfer backup roller 108 provided in a belt frame 110, and is rotated by the drive roller 100 in a direction indicated by an arrow. The intermediate transfer belt 30 is given a tension by being biased, across a tension roller 105, by a compression spring 123 which presses a shaft 105*a* of the tension roller 105.

On the other hand, between the tension roller 105 and the drive roller 100 and along the intermediate transfer belt 30, there are provided plural image bearing members for forming toner images, for example four photosensitive drums 26 for yellow (Y), magenta (M), cyan (C) and black (Bk). In FIG. 9, there are only illustrated photosensitive drums 26Y, 26Bk for the first and fourth colors.

Also, inside the intermediate transfer belt 30, there are provided plural transfer rollers 102 for executing primary transfer of the toner images of respective colors on the photosensitive drums 26, in opposed relationship to the photosensitive drums 26. In FIG. 9, there are only illustrated transfer rollers 102Y, 102Bk for the first and fourth colors.

In the color image forming apparatus of such configuration, the toner images of four colors respectively formed on the four photosensitive drums 26 are transferred, by a transfer voltage applied to the transfer rollers 102, in superposition onto the intermediate transfer belt 30. Then, the toner images of four colors, transferred in superposition onto the intermediate transfer belt 30 are collectively secondarily transferred by a secondary transfer roller 127, opposed to the secondary transfer backup roller 108 across the intermediate transfer belt 30.

On the other hand, a transfer residual toner, remaining on the surface of the intermediate transfer belt 30 after the secondary transfer, is scraped off by a blade 120 mounted on a cleaning container 124, and the scraped toner is carried by a carrier 121 to an unrepresented user toner box. The blade 120 is biased toward the tension roller 105 thereby securing a contact pressure with the intermediate transfer belt 30.

FIG. 10 is a view showing a configuration around a secondary transfer area in a state where an image forming operation is not carried out. As shown in FIG. 10, in a state where an image forming operation is not carried out, the secondary transfer roller 127 is separated from the intermediate transfer belt 30.

The secondary transfer roller 127 is provided in a secondary transfer unit 133, which provided with a pressurizing mechanism for the secondary transfer roller 127 at both ends thereof. The pressurizing mechanism is constituted of a secondary transfer roller bearing 148 constituting a member to be pressurized, a roller pressing arm 147 constituting a pressurizing member, a roller pressing spring 142, and a contact-separation cam 160.

The contact-separation cam 160 is rotated by half turns by an unrepresented cam shaft rotating mechanism, in response to a contact-separation control signal. In every half turn of the contact-separation cam 160, the roller pressing arm 147 biased by the roller pressing spring 142 executes a vertical rocking motion. As a result, the secondary transfer roller bearing 148 executes a vertical movement and the secondary transfer roller 128 repeats a contact-separation operation with the intermediate transfer belt 30.

FIG. 11 is a view showing a configuration around a secondary transfer area in a state where an image forming operation is carried out. An image formation is conducted in a state where the contact-separation cam 160 is half turned from a state where the image forming operation is not carried out as shown in FIG. 10, whereby the secondary transfer roller 127 is contacted with the intermediate transfer belt 30.

A transfer material S, conveyed by an unrepresented transfer material feeding unit, is corrected from a skewed movement by impinging on a pair of registration rollers 24 which are in a non-rotated state. Then, in synchronization with the toner images on the intermediate transfer belt 30, rotation of the paired registration rollers 24 is initiated to convey the transfer material S to a secondary transfer area. The transfer material S, conveyed to the secondary transfer area, is pinched between the intermediate transfer belt 30 and the secondary transfer roller 127 rotated in contact with the intermediate transfer belt 30, and a transfer bias is applied to the secondary transfer roller 127 whereby the toner images on the intermediate transfer belt 30 are collectively secondarily transferred onto the transfer material S.

The application of the transfer bias to the secondary transfer roller 127 is achieved by applying a bias to one (at the deeper side of the apparatus) of two bearings 148 for the secondary transfer roller, positioned on both ends of the secondary transfer roller 127. More specifically, by an unrepresented high voltage supply unit, a transfer bias is applied from the main body of the image forming apparatus to a transfer roller contact plate 117 to supply a voltage to the secondary transfer roller 127 through a convex portion 148*a* of the secondary transfer roller bearing 148 and the secondary transfer roller bearing 148 whereby the secondary transfer is conducted. Therefore the secondary transfer roller bearing 148 is formed as bearing of a conductive resin, and the convex portion 148*a* is also formed with a conductive resin. Also in a pressing portion of the roller pressing arm 147 for pressurizing the secondary transfer roller bearing 148, a transfer roller contact plate 117 for bias supply, having an KN plating (chemical nickel plating), is supported by a contact holder 116 under an insulating condition.

The transfer material S, after the secondary transfer, is conveyed through a post-transfer conveying path 34 to an unrepresented fixing device and is subjected to a pressure and heating whereby the toner images are fixed to the transfer material S.

A registration unit 32 supporting the paired registration rollers 24 is provided with a pre-registration sensor flag 41 and a photointerruptor 40*a* in order to detect presence/absence of the transfer material S and a timing of arrival. Also in the post-transfer conveying path 34, a post-transfer sensor flag 43 and a photointerruptor 40*c* are similarly provided in order to detect presence/absence of the transfer material S and a timing of arrival.

A secondary transfer unit 133 executes a rocking motion in a counterclockwise direction in the drawing, by a weight thereof, about a rocking shaft 146, whereby the secondary transfer roller 127 is rendered movable to a retracted position (cf. FIG. 12) sufficiently separated from the intermediate transfer belt 30.

In case of processing a jammed transfer material S remaining in the apparatus by a conveying failure, the user at first executes an operation of moving the secondary transfer unit 133 to the retracted position and executes a processing of a jammed sheet in a space obtained in the secondary transfer area. However, in case the processing of a jammed sheet is difficult to conduct, it is also possible to conduct the jam processing after moving the intermediate transfer belt unit 31 in a direction a shown in FIG. 9 and detaching it to the exterior of the image forming apparatus. After the intermediate transfer belt unit 31 is returned to the main body of the image forming apparatus subsequent to the jam processing, the secondary transfer unit 133 is moved to a position capable of image formation.

Also at a replacement of the secondary transfer roller 127 which is a consumable component, the user moves the secondary transfer unit 133 to the retracted position, then pulls out the secondary transfer roller unit 161, which supports the secondary transfer roller 127 and the secondary transfer roller bearing 148, to a front side in the axial direction (cf. FIG. 13), and executes the replacement of the secondary transfer roller 127.

However, in the above-described apparatus of the background technology, there may result a drawback that toner dropping from the secondary transfer area, fine powder generated from the transfer material S and toner scattered in the apparatus are deposited on the transfer roller contact plate 117 to result in an unstable electrical conduction between the secondary transfer roller bearing 148 and the transfer roller contact plate 117, thus generating a failure in the electrical contact.

Also, since a sufficient transfer pressure is required for securing a transfer property even on a transfer material with a coarse surface, the pressurization of the secondary transfer roller 127 is made with a high leverage ratio utilizing the roller pressing arm 147. As a result, in a contact state of the secondary transfer arm 127 as shown in FIGS. 10 and 11, the moving direction of the secondary transfer roller bearing 149 does not become parallel to the pressurizing direction of the roller pressing arm 147 on the secondary transfer roller bearing 148. Therefore a rotary moment is generated on the secondary transfer roller bearing 148 to cause a deformation of the transfer roller unit 161, thereby inhibiting the contact-separation operation of the secondary transfer roller 127.

Furthermore, because of an influence in a play in the fitting of the secondary transfer roller bearing 148 in the secondary transfer roller unit 161, a position (action point) pressing the secondary transfer roller bearing 149 on the transfer roller contact plate 117 fluctuates on each contact-separation operation of the secondary transfer roller 127, thereby aberrating, though slightly, the alignment of the secondary transfer roller 127 with respect to the secondary transfer backup roller 108.

SUMMARY OF THE INVENTION

An object of the present invention is to provide an image forming apparatus capable of preventing a contact failure caused for example by an intrusion of toner or the like in an electrical contact portion.

Another object of the present invention is to provide an image forming apparatus including an image bearing member, a transfer member for transferring a toner image from the image bearing member, a first contact portion and a second contact portion mutually contactable for applying a voltage to the transfer member, wherein a pressure exerted between the first contact portion and the second contact portion causes the transfer member to be pressed toward the image bearing member, and the first contact portion has a convex portion of which a hardness is higher than a hardness of the second contact portion.

A further object of the present invention is to provide an image forming apparatus including an image bearing member, a transfer member for transferring a toner image from the image bearing member, a first contact portion and a second contact portion mutually contactable for applying a voltage to the transfer member, wherein a pressure exerted between the first contact portion and the second contact portion causes the transfer member to be pressed toward the image bearing member, and the first contact portion has a convex portion the second contact portion has a concave portion.

A further object of the present invention is to provide an image forming apparatus including a voltage applied member to which a voltage is applied, and a first contact portion and a second contact portion mutually contactable for applying a voltage to the voltage applied member, wherein a pressure exerted between the first contact portion and the second contact portion causes the voltage applied member to be pressed, and the first contact portion has a convex portion of which a hardness is higher than a hardness of the second contact portion.

A further object of the present invention is to provide an image forming apparatus including a voltage applied member to which a voltage is applied, and a first contact portion and a second contact portion mutually contactable for applying a voltage to the voltage applied member, wherein a pressure exerted between the first contact portion and the second contact portion causes the voltage applied member to be pressed, and the first contact portion has a convex portion and the second contact portion has a concave portion.

A still further objects of the present invention will become fully apparent from the following description.

DESCRIPTION OF THE PREFERRED EMBODIMENTS

Figure 1:
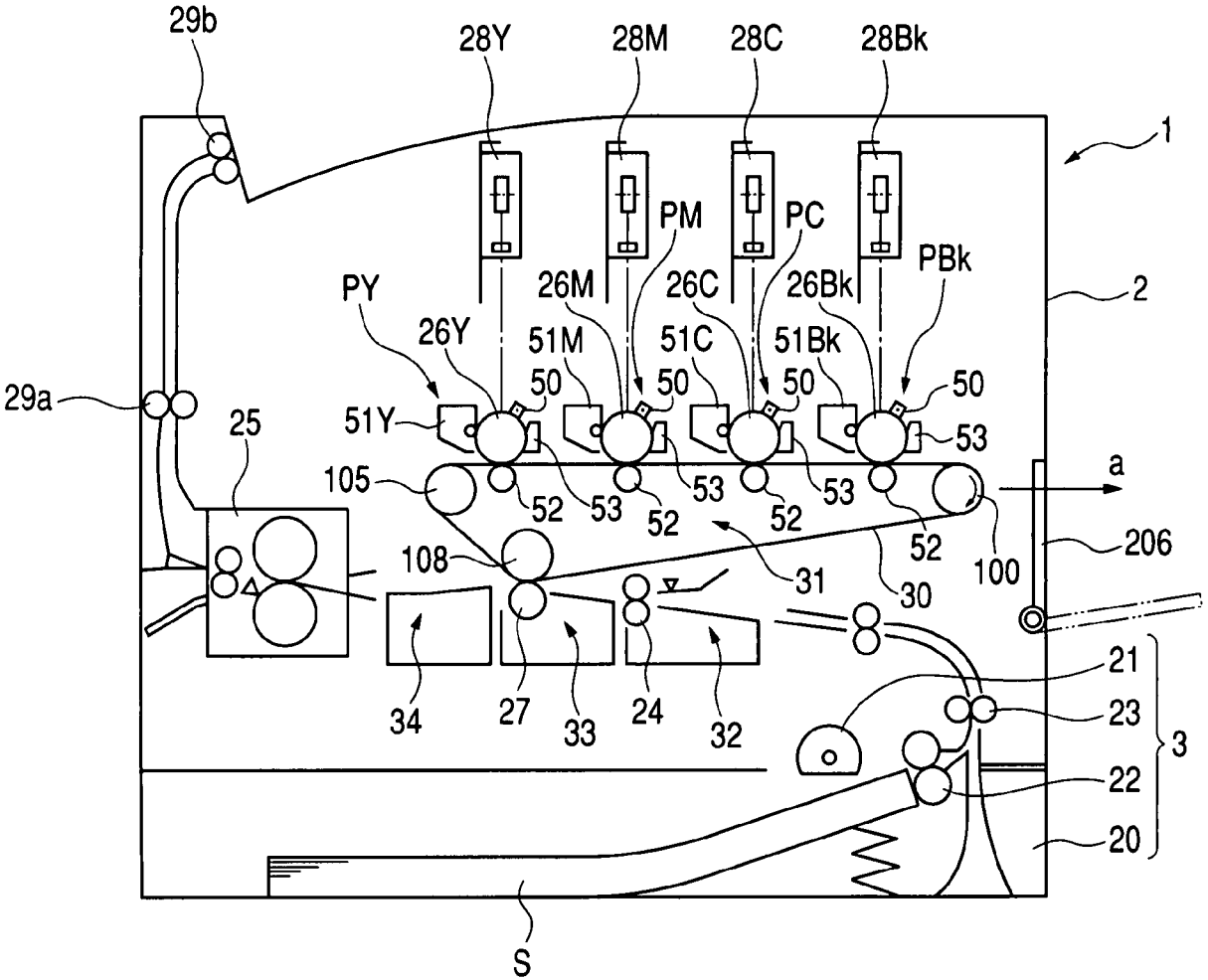
FIG. 1 is a view showing an image forming apparatus embodying the present invention.

Now an embodiment of the image forming apparatus of the present invention will be explained with reference to FIG. 1. FIG. 1 is a view showing a schematic configuration of a 4-drum full-color image forming apparatus employing an intermediate transfer belt constituting an example of the image forming apparatus of the present embodiment.

As shown in FIG. 1, a 4-drum full-color image forming apparatus is constituted of a main body 2 of the 4-drum full-color image forming apparatus (hereinafter called apparatus main body), process cartridges P (PY, PM, PC, PBk) of 4 colors of yellow (Y), magenta (M), cyan (C) and black (Bk), detachably mounted on the apparatus main body 2, etc. The apparatus main body 2 is provided with laser exposure devices 28 (28Y, 28M, 28C, 28Bk) an intermediate transfer member unit 31, a feeding unit 3 and a fixing device 25.

The process cartridges P of respective colors are provided with photosensitive drums 26 (26Y, 26M, 26C, 26Bk) as image bearing members, primary chargers 50, and developing devices 51 (51Y, 51M, 51C, 51Bk), and are arranged parallel along an intermediate transfer belt 30. The primary chargers 50 are positioned on external peripheries of the photosensitive drums 26, and uniformly charge the surfaces of the respective photosensitive drums. The developing devices 51 develop electrostatic latent images formed, corresponding to respective colors, on the photosensitive drums by exposures with the laser exposure devices 28 (28Y, 28M, 28C, 28Bk), with toners of respective colors of yellow, magenta, cyan and black.

Also primary transfer rollers 52 as primary transfer units together with the photosensitive drums 26, are positioned in positions pinching the intermediate transfer belt 30 in cooperation with the photosensitive drums 26.

The intermediate transfer belt unit 31 is provided with an intermediate transfer belt 30 as an image bearing member, and three rollers supporting the intermediate transfer belt 30, namely a drive roller 100, a tension roller 105 and a secondary transfer backup roller 108.

In a position opposed to the secondary transfer backup roller 108 across the intermediate transfer belt 30, there is provided a secondary transfer roller 27 which is supported by a secondary transfer unit 33. The secondary transfer roller 27 is a member for transferring toner images from the photosensitive drum 26 as the image bearing member, and constitutes a voltage applied member to which a voltage is applied.

A feeding unit 3 is provided with a cassette 20 containing plural transfer materials S, a feeding roller 21, conveying rollers 23, retard rollers 22 for preventing superposed feeding, a registration unit 32 supporting a pair of registration rollers 24 etc. The feeding unit 3 feeds a transfer material S to the secondary transfer unit constituted of a contact portion between the secondary transfer roller 27 and the secondary transfer backup roller 108 contacted across the intermediate transfer belt 30.

In detaching the intermediate transfer belt unit 31 from the apparatus main body 2, a unit replacing door 206 on a lateral wall of the apparatus main body 2 is opened and the intermediate transfer belt unit 31 is extracted in a direction a. In order that the intermediate transfer belt unit 31 can be extracted in this operation, the secondary transfer unit 33 and the registration unit 32 are rendered retractable to unrepresented positions. The unit replacing door is used not only at the replacement of the intermediate transfer belt unit but also for removing a jammed sheet to the exterior of the apparatus.

In the following there will be explained an image forming operation of the 4-drum full-color image forming apparatus 1.

When an image forming operation is initiated, the transfer material S in the cassette 20 is at first fed by the feeding roller 21, then separated into a single sheet by the paired retarding rollers 22 and conveyed, through the transport rollers 23 etc., to the paired registration rollers 24. The registration rollers 24 in this state are not rotated, and a skew in the transfer material S is corrected by causing the transfer material S to impinge on a nip of the paired registration rollers 24.

On the other hand, parallel to the conveying operation of the transfer sheet S, for example in the yellow process cartridge PY, the surface of the photosensitive drum 26Y is uniformly negatively charged by the primary charger 50, and is then subjected to an imagewise exposure by the laser exposure device 28Y whereby an electrostatic latent image corresponding to a yellow image component of the original (output image) on the surface of the photosensitive drum 26Y.

Then the electrostatic latent image is developed with a negatively charged yellow toner in the developing device 51Y, thus being rendered visible as a yellow toner image. The yellow toner image thus obtained is primary transferred by the primary transfer roller 52 onto the intermediate transfer belt 30. After the transfer of the toner image, the photosensitive drum 26Y is subjected to elimination of a transfer residual toner remaining on the surface and is used again for a next image formation.

Similarly, toner images of respective colors formed on the photosensitive drums 26 in other process cartridges PM, PC, PBk are primary transferred in the respective primary transfer areas at predetermined timings in succession and in superposition onto the intermediate transfer belt 30.

Then, the toner images of four colors, transferred onto the intermediate transfer belt 30, are moved by the rotation thereof to the secondary transfer area. Also transfer material S, corrected from skew by the paired registration rollers 24, is advanced to the secondary transfer area in synchronization with the images on the intermediate transfer belt 30. Then, by the secondary transfer roller 27 in contact with the intermediate transfer belt 30 across the transfer material S, the toner images of four colors thereon are transferred onto the transfer material S.

The transfer material S, bearing the transferred toner images, is conveyed through the post-conveying path 34 to the fixing device 35 where the toner images are fixed, and is discharged and stacked on an upper surface of the apparatus through a lower pair 29*a* of discharge rollers and an upper pair 29*b* of discharge rollers. The intermediate transfer belt 30 after the secondary transfer is subjected, by an unrepresented belt cleaner, to elimination of a transfer residual toner remaining on the surface.

Now there will be explained a configuration around the secondary transfer area.

Figure 2:
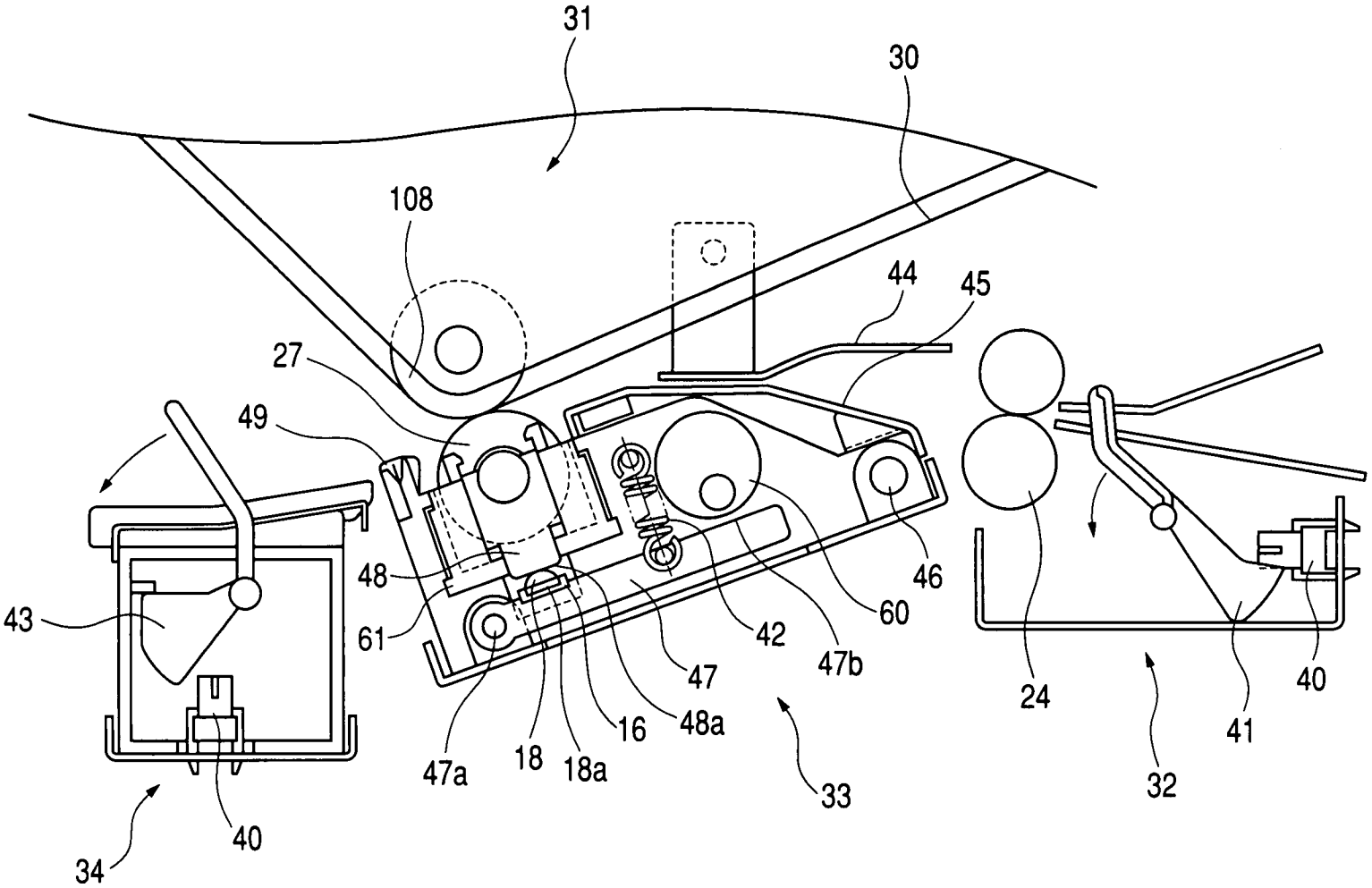
FIG. 2 is a view showing a state where a secondary transfer roller is in contact with an intermediate transfer belt (rear side of apparatus)

As shown in FIG. 2, the registration unit 32 is constituted of the paired registration rollers 24, a pre-registration sensor flag 41 and a photointerruptor 40. The pre-registration sensor flag 41 has an axis of rotation at the center, and is biased a clockwise direction, in the drawing, by an unrepresented spring in such a manner that an end intercepts the conveying path of the transfer material S while the other end does not intercept the photointerruptor 40. When the transfer material S is presented immediately in front of the paired registration rollers 24, the pre-registration sensor flag 41 is in contact at an end thereof with the transfer material S and is rotated in a retracting direction of the conveying path of the transfer material S by the conveying power thereof, whereby the other end of the pre-registration sensor flag 41 moves to a position intercepting the photointerruptor 40 (inclined in a direction indicated by an arrow in the drawing) to detect presence/absence of the transfer material S and passing timings of a front end and a rear end of the transfer material S.

Also in the post-transfer conveying path 34, there are similarly provided a post-transfer sensor flag 43, biased in the clockwise direction by an unrepresented spring, and a photointerruptor 40, in order to detect that the transfer material S after the secondary transfer is conveyed to the fixing device 25 at a predetermined timing, without sticking to the intermediate transfer belt 30.

The secondary transfer unit 33 is provided with a secondary transfer roller unit 61, a charging eliminating needle 49 for charge elimination of the transfer material after the transfer, and a pre-transfer lower guide 45, and is rendered rotatable about a rocking shaft 46. The pre-transfer lower guide constitutes, in cooperation with a pre-transfer upper guide 44 provided in the intermediate transfer belt unit 31, a pre-transfer conveying path.

The secondary transfer unit 33 is provided with pressurizing mechanisms for the secondary transfer roller 27 on both ends thereof. The pressurizing mechanism is constituted of a secondary transfer roller bearing 48, a roller pressing arm 47, a roller pressing spring 42, a contact-separation cam 60 etc. The secondary transfer roller 27 is supported by the secondary transfer roller bearing 48 provided in the secondary transfer roller unit 61.

The roller pressing arm 47 is provided at an end thereof with a rotary shaft 47*a*, an electrically insulating contact holder 16 in the vicinity of the rotary shaft 47*a*, and a semi-spherical pressing portion 18 constituting a first contact portion (contact area), and, at the other end, with a contact portion 47*b* coming into contact with the contact-separation cam 60, and is pulled up at the other end by the roller pressing spring 42 in such a direction that the secondary transfer roller 27 comes into contact with the intermediate transfer belt 30. The pressing portion 18 is formed by caulking a semi-spherical metal (Fe) pin constituting a convex portion on a metal plate 18*a* and applying an NK plating (chemical nickel plating), and is supported under insulation by the contact holder 16.

The secondary transfer roller bearing 48, constituting a support member for supporting the secondary transfer roller 27, is formed with an electrically conductive resin (POM), and forms a flat contact face 48*a* constituting a second contact portion (contact area) in contact with the pressing portion 18. Thus, the second contact portion 48*a* constitutes a part of the support member 48.

The first contact portion 18 and the second contact portion 48*a* are capable of a mutual contact for applying a voltage to the secondary transfer roller 27.

The pressing portion 18 is provided, in the vertical direction, under the contact face 48*a*, and has a hardness higher than that of the contact face 48*a*, since the pressing portion 18 is made of a metal while the bearing 48 is made of a resin.

The contact and separation of the secondary transfer roller 27 and the intermediate transfer belt 30 under the pressurizing mechanism are executed by a half turn each time of the contact-separation cam 60 through a cam shaft rotating mechanism (not shown) in response to a contact-separation control signal.

FIG. 2 shows a state during an image forming operation, in which the secondary transfer unit 33 is positioned by a secondary transfer unit support member (not shown) in the vicinity of the intermediate transfer belt unit 31. In such state, the contact-separation cam 60 is separated from the contact portion 47*b* of the roller pressing arm 47, whereby the roller pressing arm 47 is pulled up by the roller pressing arm 42 and the pressing portion 18 is provided in a first position. The pressing portion 18 of the roller pressing arm 47 pressurizes the contact face 48*a* of the secondary transfer roller bearing 48 thereby bringing the secondary transfer roller 27 in contact with the intermediate transfer belt 30. Stated differently, a pressure exerted between the first contact portion 18 and the second contact portion 48*a* causes the transfer member 48 to be pressed toward the image bearing member 30.

Figure 4:
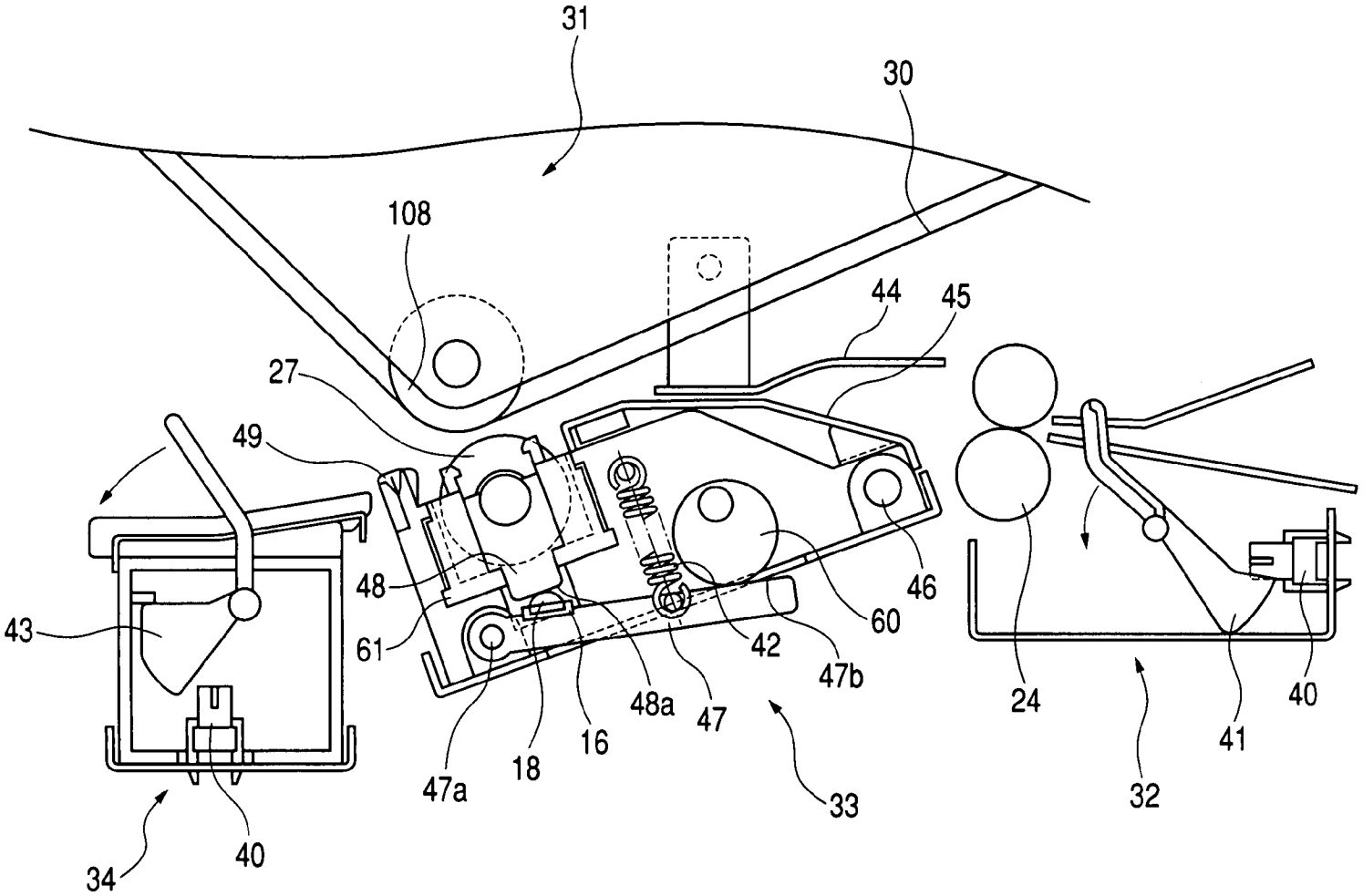
FIG. 4 is a view showing a state where the secondary transfer roller is separated from the intermediate transfer belt.

When the contact-separation cam 60 is rotated from this state by a half turn, it depresses the contact portion 47*b* downwards whereby the roller pressing arm 47 is rotated downwards about the rotary axis 47*a* and the pressing portion 18 comes to a second position. As a result, the pressing portion 18 moves in a direction separated from the contact face 48*a* and the secondary transfer roller 48 moves downwards by a weight thereof whereby the secondary transfer roller 27 is separated from the intermediate transfer belt 30 (cf. FIG. 4).

At the secondary transfer of the toner image from the intermediate transfer belt 40 to the transfer material, a transfer bias is applied to the secondary transfer roller 27. The application of the transfer bias to the secondary transfer roller 27 is executed, in a state where the pressing portion 18 is in contact with the contact face 48*a*, by applying the transfer bias by a high-voltage supply unit (not shown) from the main body of the image forming apparatus to the pressing portion 18, thereby applying the bias to one (rear side of the apparatus) of the two secondary transfer roller bearings 48 provided on both ends of the secondary transfer roller 27.

Figure 3:
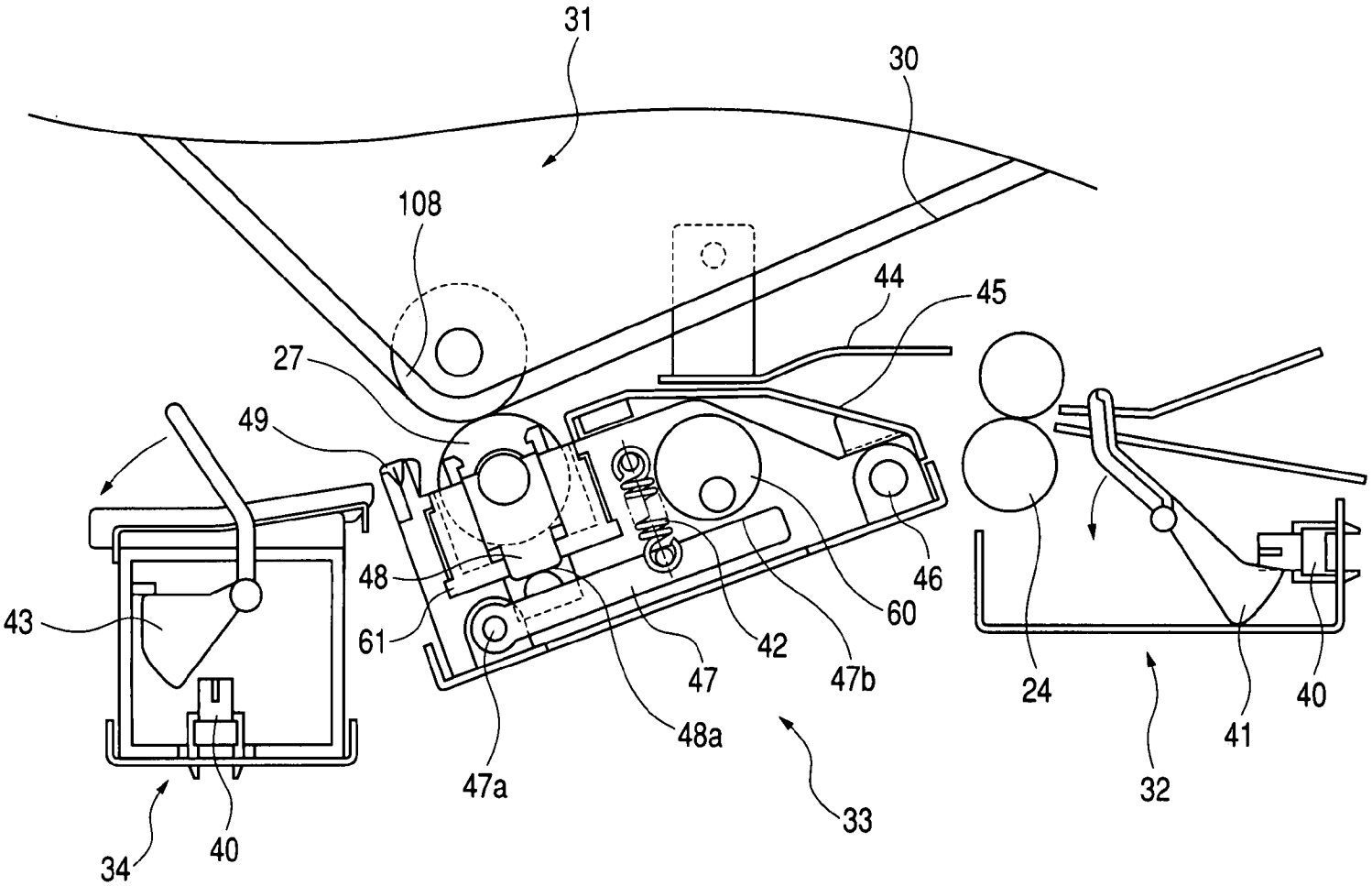
FIG. 3 is a view showing a state where the secondary transfer roller is in contact with the intermediate transfer belt (front side of apparatus)

On the other hand, a pressurizing mechanism for the secondary transfer roller 27, positioned at the front side of the apparatus main body and not used for the application of the transfer bias, is not provided with the contact holder 16, as shown in FIG. 3, in comparison with the configuration at the rear side, but is merely provided with a semi-spherical metal pressing portion on the metal roller pressing arm.

In the present embodiment, as explained in the foregoing, the contact portion of the roller pressing arm 47 employs a semi-spherical metal pressing portion 18 while the contact face 48*a* of the secondary transfer roller bearing 48 employs a flat resin material, whereby, in a pressurized state, the pressing portion 18 is pressed into the contact face 48*a* to form a dimple 48*b* or a concave portion, because of a difference in the hardness of the two.

Figure 14B:
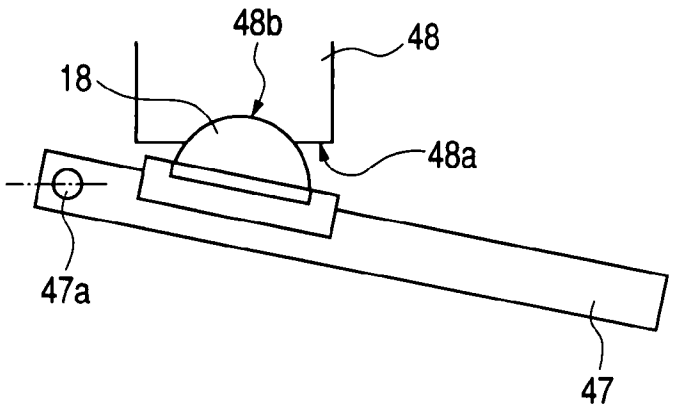
FIG. 14B is a detailed view showing an electrical contact portion in FIG. 4.
Figure 14A:
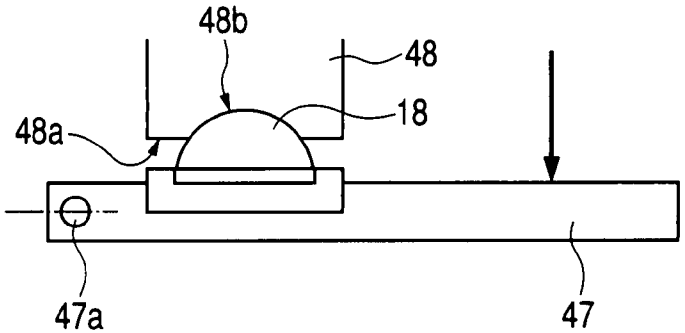
FIG. 14A is a detailed view showing an electrical contact portion in FIG. 2.

FIGS. 14A and 14B show a state where the pressing portion 18 is pressed into the contact face 48*a*, in which FIG. 14B shows a state reached by pressing down the arm 47 as indicated by an arrow from a state shown in FIG. 14A. Therefore, in the present embodiment, when the roller 27 is separated, the arm 47 rotates about the axis 47*a* whereby the pressing portion 18 rotates with respect to the contact face 48*a*, but the pressing portion 18 and the dimple 48*a* of the contact face 48 can maintain a contact state (from FIG. 14A to FIG. 14B) even under the rotation of the arm 47 because the pressing portion 18 spherical (arch shaped), thereby preventing intrusion of toner.

Figure 15:
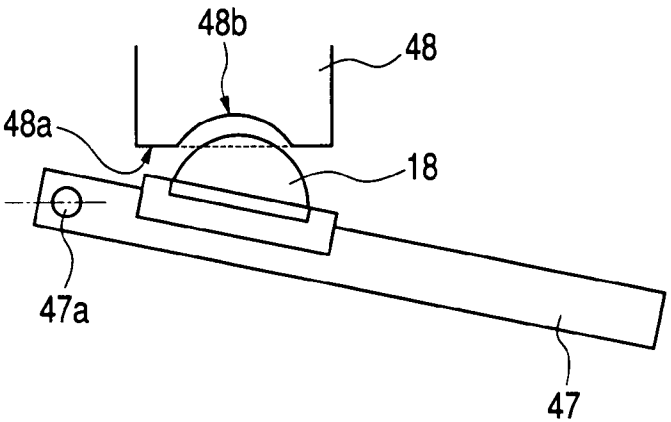
FIG. 15 is a view showing a case where a gap is generated in the electrical contact portion.

Also in the present embodiment, even in case a slight gap is generated between the pressing portion 18 and the contact face 48*a* as shown in FIG. 15 when the lever 47 is lowered, the slight dimple 48*b* formed by a plastic deformation of the secondary transfer roller bearing 48 can cover an apex portion of the pressing portion 18, whereby the toner is less likely to enter between the pressing portion 18 and the contact face 48*a* and an electrical connection failure therebetween can therefore be prevented.

The dimple on the contact face may be formed in advance, but such preformed dimple results in a contact failure in case it is displaced from the pressing portion, so that the dimple of the contact face is preferably formed by pressing in order to stabilize the action point at the pressurization.

Also in the present embodiment, since the pressing portion 18 having the semi-spherical contact face is positioned at the lower side in the vertical direction while the secondary transfer roller bearing 48 having the contact face 48*a* is positioned at the upper side in the vertical direction so as to cover the semi-spherical portion, it is rendered possible to prevent intrusion of toner dropping from the secondary transfer area, fine power generated from the transfer material or toner scattered in the apparatus into the secondary transfer roller bearing 48 and the pressing portion 18 of the roller pressing arm 47, since the toner etc. does not easily stick to an upward convex spherical surface, it is possible to securely ensure the conduction of the electrical contact.

Also in the present embodiment, the contact face 48*a* of the secondary transfer roller bearing 48*a* is formed by a flat surface and is perpendicular to the movable direction of the secondary transfer roller bearing 48. Therefore, during a displacement of the secondary transfer roller 27 from a state in contact with the intermediate transfer belt 40 (FIG. 4) to a separated state (FIG. 2), the secondary transfer roller bearing 48 is pressed in a direction parallel to the movable direction thereof, since the pressing portion 18 of the roller pressing arm 47 has a semi-spherical shape (spherical surface having an arc portion). As a result, an unnecessary rotational moment does not act on the secondary transfer roller bearing 48 as in the background technology, and the contacting motion of the secondary transfer roller 27 is conducted smoothly under a stabilized pressurizing direction.

In case of a processing for a jammed transfer material S remaining in the apparatus by a conveying failure, the user at first executes an operation of moving the secondary transfer unit 33 to the retracted position, and executes a jam processing in a space formed in the secondary transfer area. However, in case such jam processing is difficult to execute, it is also possible to execute the jam processing after moving the intermediate transfer belt unit 31 in a direction a shown in FIG. 1 thereby detaching the unit to the exterior of the apparatus. Then, after the jam processing, the intermediate transfer belt unit 31 is returned to the main body of the image forming apparatus and the secondary transfer unit 33 is shifted to a position capable of image formation.

Figure 5:
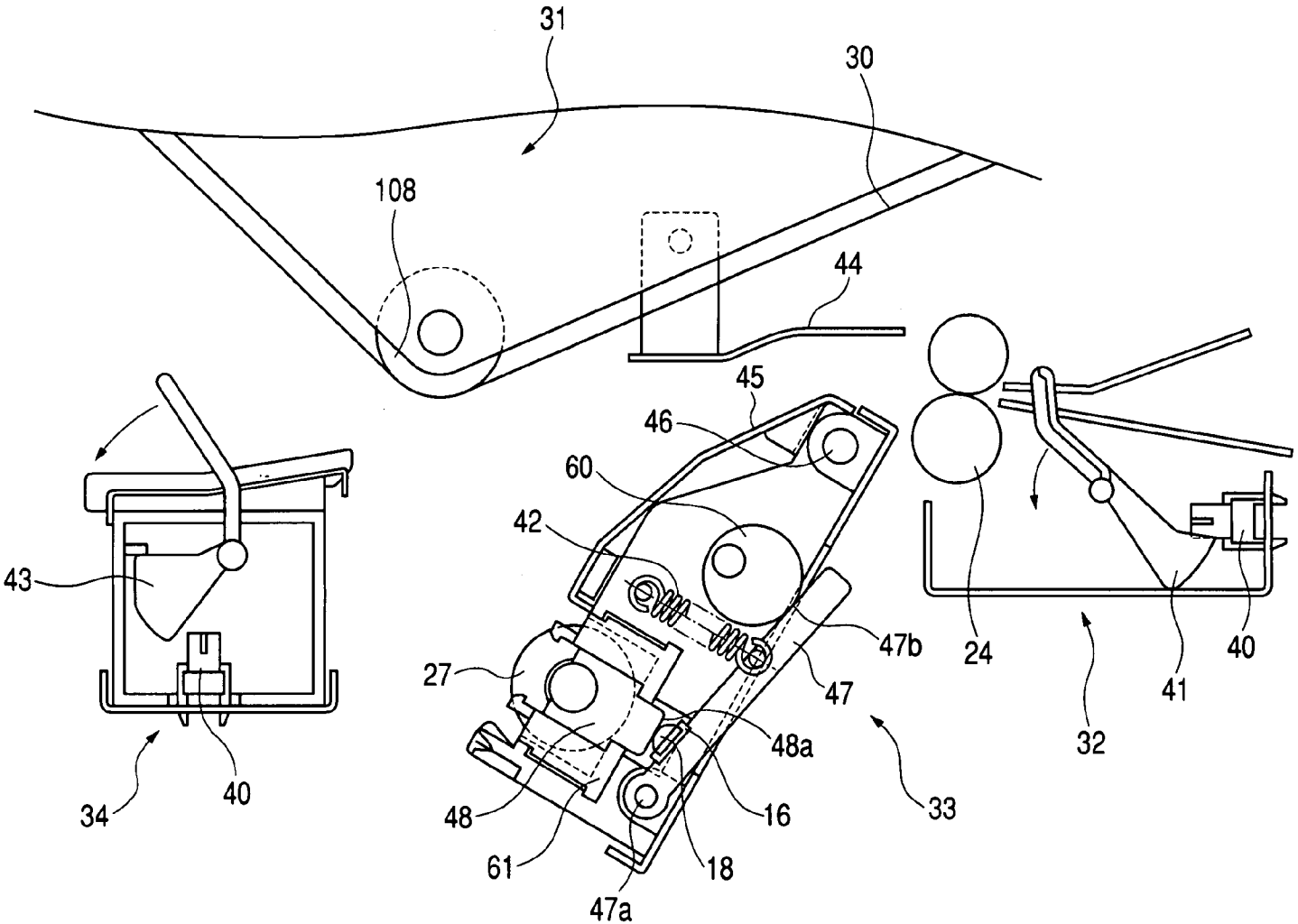
FIG. 5 is a view showing a state where the secondary transfer roller is retracted from the intermediate transfer belt unit.

Also in case of replacing the secondary transfer roller 27 which is a consumable component, the user moves the secondary transfer unit 33 to the retracted position (cf. FIG. 5), then pulls out the secondary transfer roller unit 61 supporting the secondary transfer roller 27 and the secondary transfer roller bearing 48 toward the front along the axial direction of the secondary transfer roller 27 (cf. FIG. 6), and executes the replacement of the secondary transfer roller 27.

Figure 7:
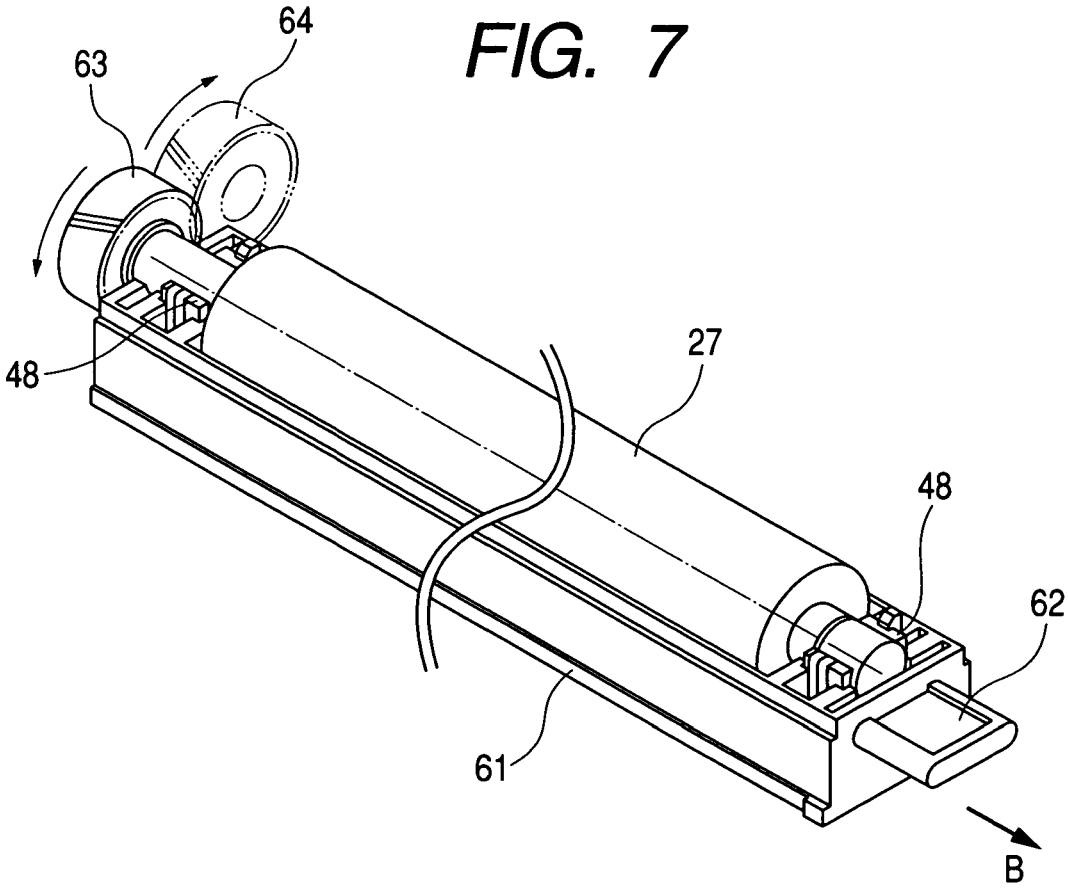
FIG. 7 is a perspective view of the secondary transfer roller unit.
Figure 8A:
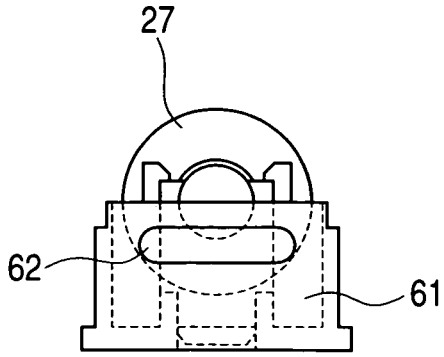
FIG. 8A is an elevation view of the secondary transfer roller unit.
Figure 8B:
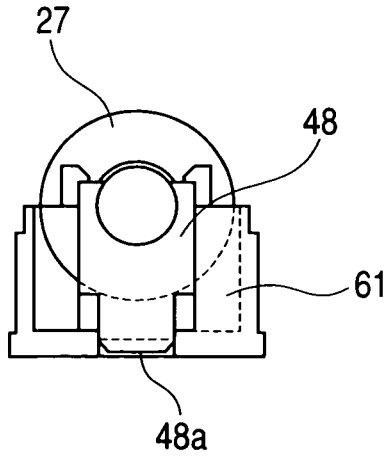
FIG. 8B is a cross-sectional view of the secondary transfer roller unit.
Figure 9:
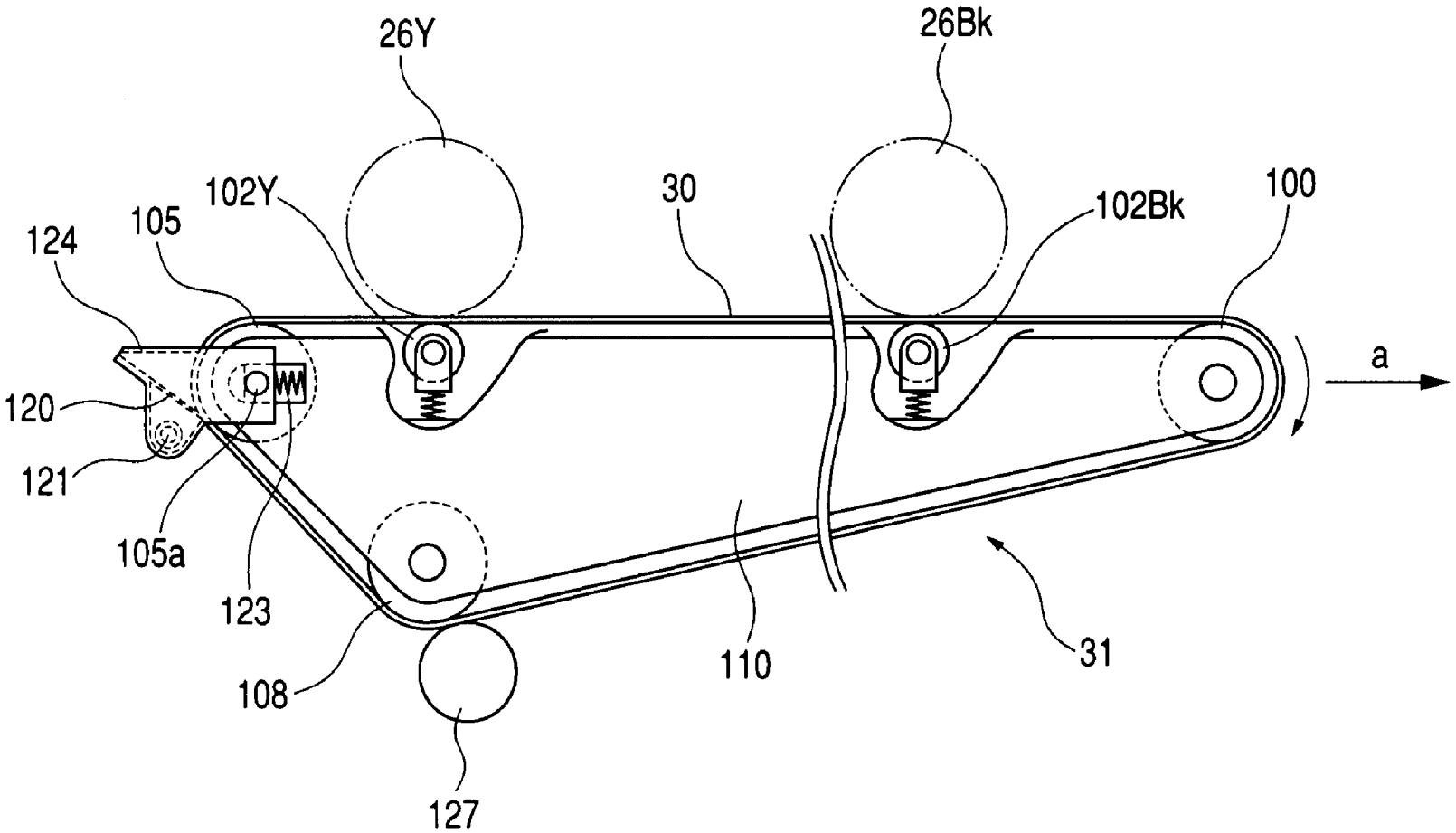
FIG. 9 is a view showing an image forming unit constituting a background technology of the present invention.
Figure 10:
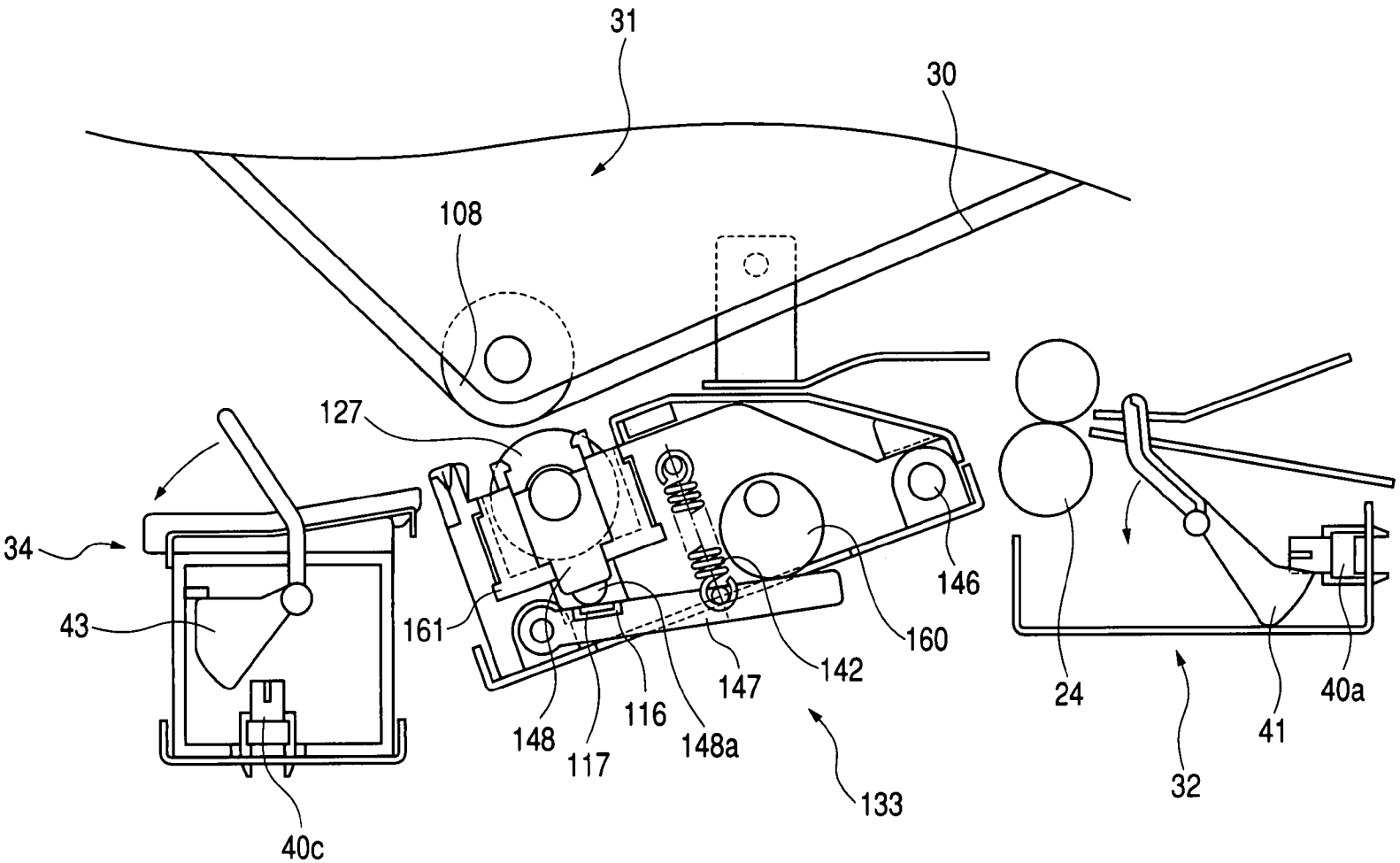
FIG. 10 is a view showing a state where the secondary transfer roller shown in FIG. 9 is separated from the intermediate transfer belt.
Figure 11:
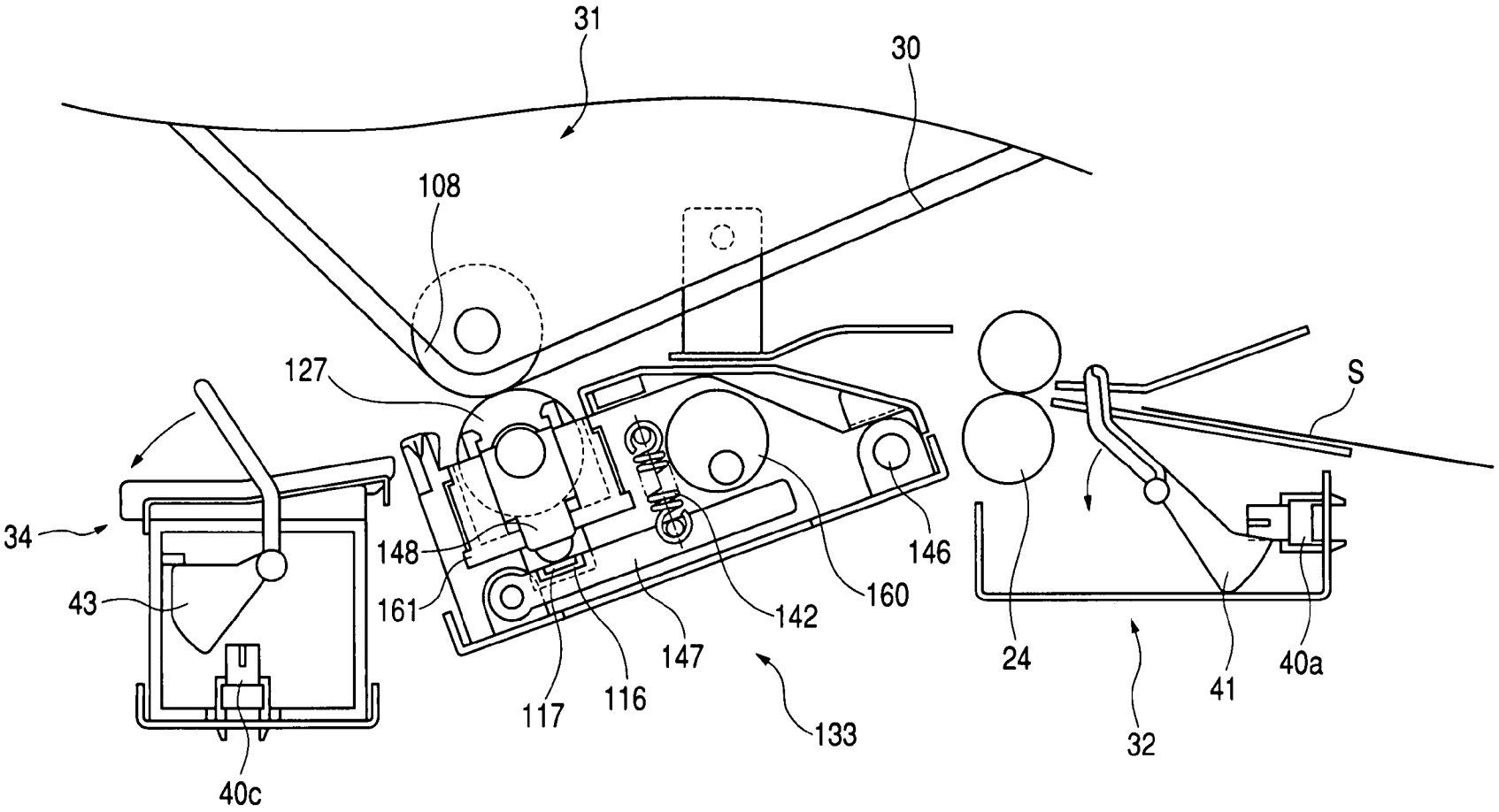
FIG. 11 is a view showing a state where the secondary transfer roller shown in FIG. 9 is in contact with the intermediate transfer belt.
Figure 12:
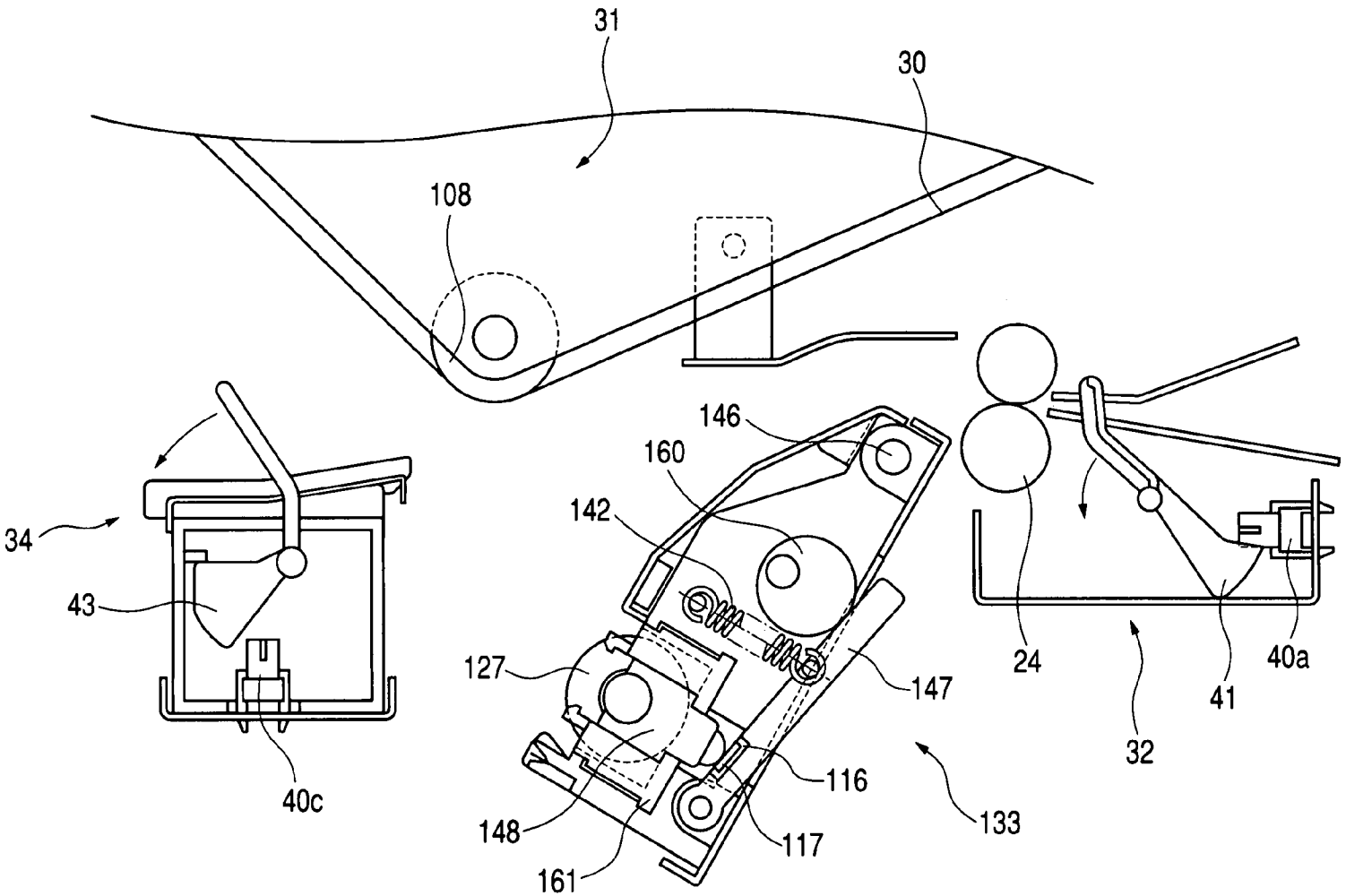
FIG. 12 is a view showing a state where the secondary transfer unit shown in FIG. 10 is retracted from the intermediate transfer belt unit.
Figure 13:
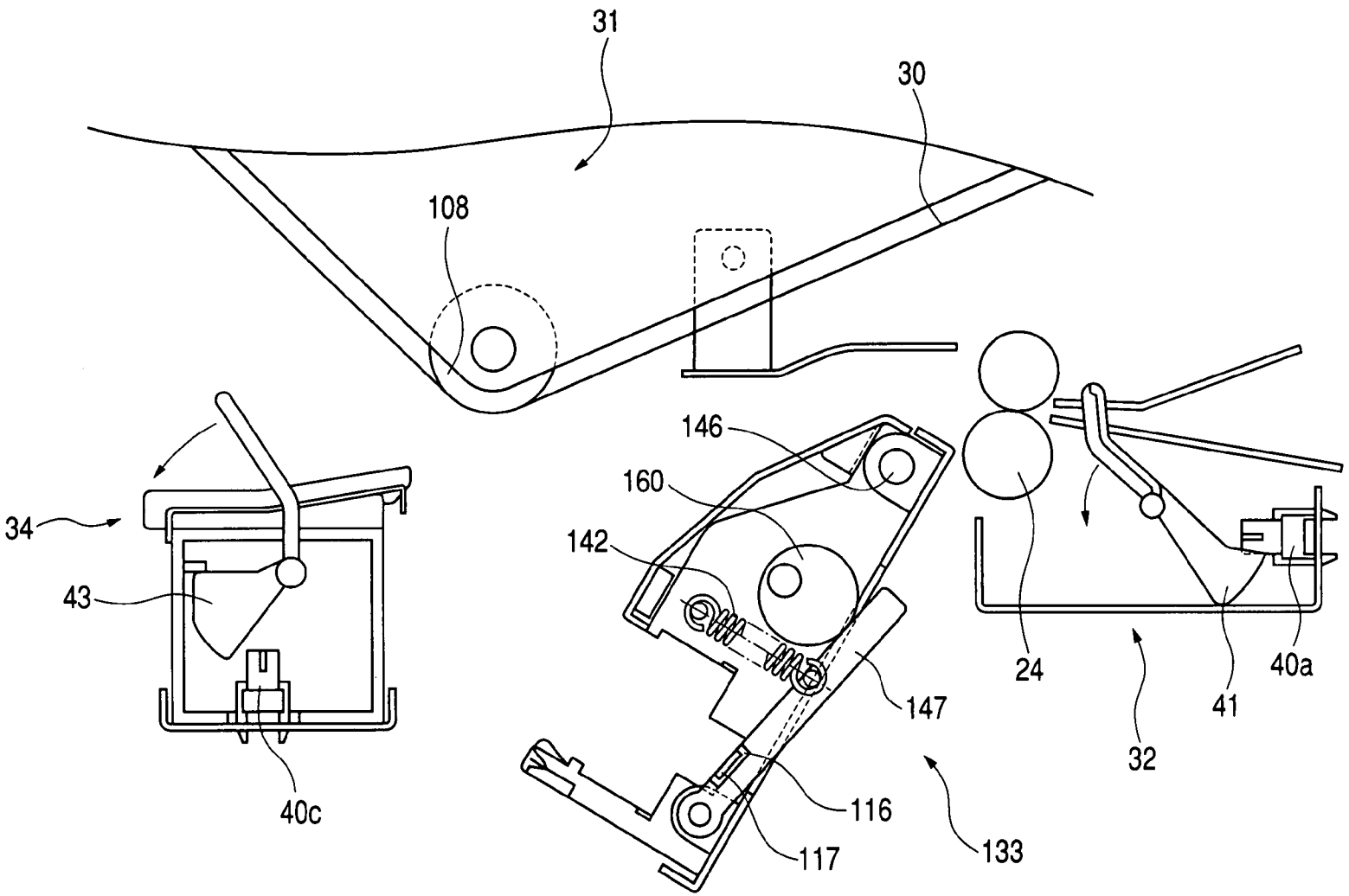
FIG. 13 is a view showing a state where the secondary transfer roller unit is detached from the secondary transfer unit shown in FIG. 12.

FIGS. 7, 8A and 8B are respectively a perspective view, an elevation view and a cross-sectional view of the secondary transfer roller unit 61 extracted from the secondary transfer unit 33.

As shown in FIGS. 7, 8A and 8B, the secondary transfer roller unit 61 is constituted of a secondary transfer roller 27, secondary transfer roller bearings 48, a roller gear 63 etc., and the user can replace the consumable component without smearing the hands, by replacing the entire secondary transfer roller unit 61.

Figure 6:
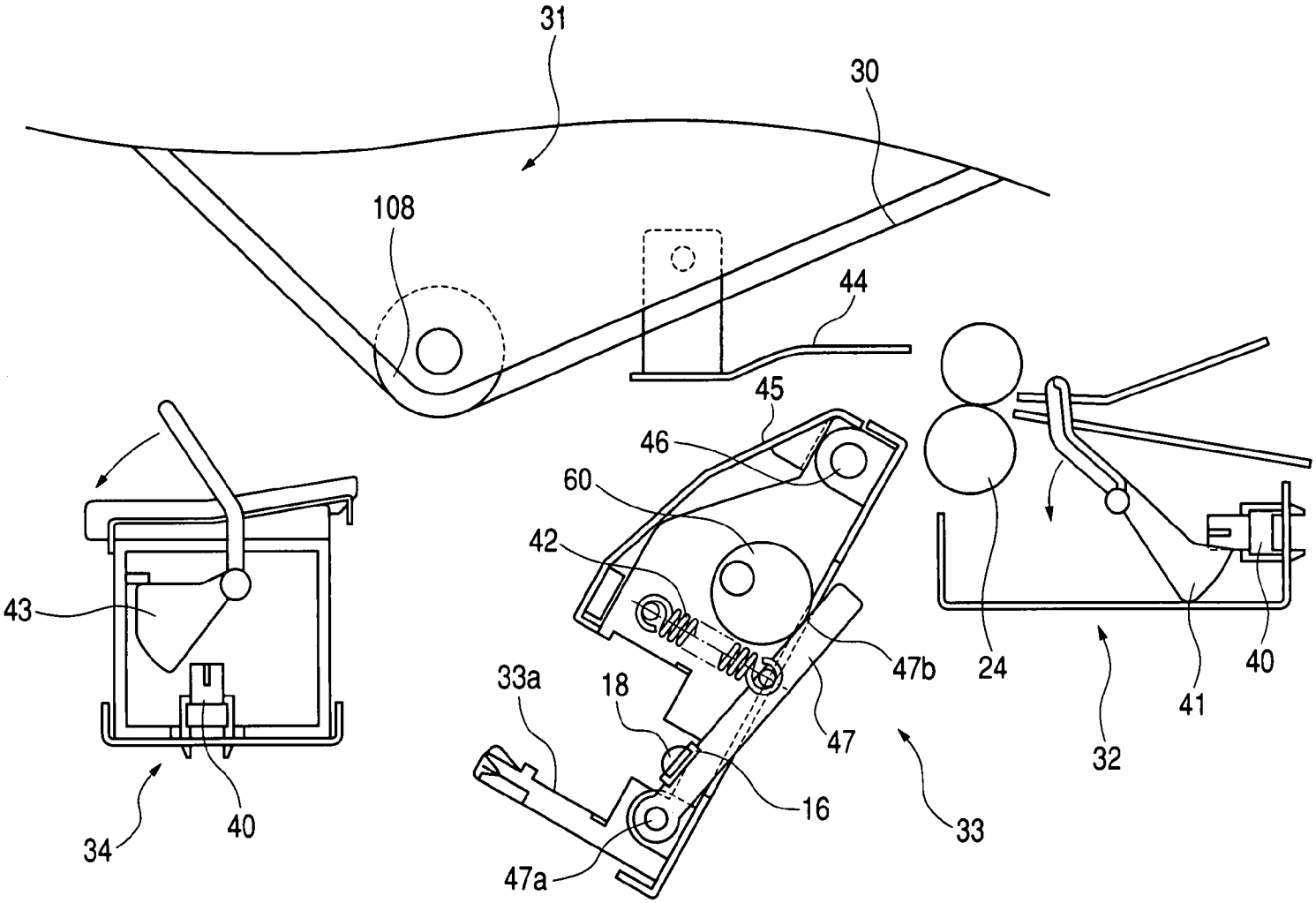
FIG. 6 is a view showing a state where the secondary transfer roller unit is detached from the secondary transfer unit.

Referring to FIG. 6, a secondary transfer roller unit mounting portion 33*a* for the secondary transfer unit 33 defines the position of a secondary transfer roller unit 61 when it is mounted and also constitutes a guide surface for the mounting of the secondary transfer roller unit. Therefore the user can mount the secondary transfer roller unit 61 in the secondary transfer unit 33 by merely pressing the secondary transfer roller unit 61 into the secondary transfer roller unit mounting portion.

Also in a state shown in FIG. 2 where the secondary transfer unit 33 is set at the intermediate transfer belt unit 31, a roller gear 63 provided in the secondary transfer roller 27 as shown in FIG. 7 meshes with a drive gear 64 rotatably supported by the secondary transfer unit 33 thereby rotating the secondary transfer roller.

In the present embodiment, the unit 33 is rotated about the shaft 46 at the processing a jammed sheet, but in case the separation of the roller 27 is enough such as a simple jam processing or a stand-by state of the apparatus, the roller 27 alone can be moved while the unit 33 is maintained fixed, and the positional precision of the guide 45, the charge eliminating needle 49 etc. can be improved by not moving the unit 33 as far as possible.

The effect of the present invention is not limited to the aforementioned embodiment, and the contact face 48*a* in contact with the semi-spherical pressing portion 18 may be constituted of a concave surface of a curvature smaller than that of the semi-spherical portion. Also the contact portion is not limited to a contact portion for the high-voltage, but can also be a contact portion for grounding. Also the secondary transfer roller bearing 48 is not limited for supporting the secondary transfer roller 27 but may also be used for supporting another roller or belt for conveying the transfer material S.

In the present embodiment, as explained in the foregoing, a contact portion of a pressurizing mechanism serving also as an electrical contact executing a contact-separation operation for the second transfer roller etc. is so constructed that a contact face of a pressing member of a convex shape, which may be subjected to a dropping of toner or powder dust, is covered at the upper side in the vertical direction by a contact face of a pressurized member, whereby the contact face (electrical contact) is prevented from deposition of toner or powder dust and is protected from a contact failure.

Also as the pressing member of convex shape executes a pressurization parallel to the moving direction of the pressurized member, a rotational moment is not caused on the pressed member and the direction of pressurization can be stabilized.

Also, as the material constituting the contact portion of the pressing member is higher than that of the material constituting the contact portion of the pressed member, the contact face of the pressing member is pressed into the contact face of the pressed member, whereby the pressing position does not fluctuate at each contact-separation operation, and the pressing position and the pressing direction can be stabilized.

The present invention has been explained by embodiments thereof, but the present invention is not limited by such embodiments and is subject to any and all modifications within the technical concept of the present invention.

What is claimed is:

1. An image forming apparatus comprising:

an image bearing member;

a transfer member for transferring a toner image from said image bearing member; and a first contact portion and a second contact portion which can be mutually contacted for applying a voltage to said transfer member, said first contact portion having a convex portion;

wherein said transfer member is pressed toward said image bearing member by a pressure exerted between said first contact portion and said second contact portion; and said convex portion has a hardness larger than a hardness of said second contact portion.

2. An image forming apparatus according to claim 1, wherein said convex portion is pressed into said second contact portion to form a concave portion in said second contact portion.

3. An image forming apparatus according to claim 1, wherein said convex portion is upward and said second contact portion covers said convex portion from above.

4. An image forming apparatus according to claim 1, wherein said convex portion is spherical.

5. An image forming apparatus according to claim 1, wherein said first contact portion is movable to a first position where said image bearing member and said transfer member are contacted, and a second position where said image bearing member and said transfer member are not contacted.

6. An image forming apparatus according to claim 5, wherein said convex portion is provided on a member of which an end is rotatably supported.

7. An image forming apparatus according to claim 1, further comprising a support member for supporting said transfer member, wherein said second contact portion is a part of said support member.

8. An image forming apparatus according to claim 7, wherein said transfer member is a roller and said support member is a bearing.

9. An image forming apparatus comprising:

an image bearing member;

a transfer member for transferring a toner image from said image bearing member; and a first contact portion and a second contact portion which can be mutually contacted for applying a voltage to said transfer member;

wherein said transfer member is pressed toward said image bearing member by a pressure exerted between said first contact portion and said second contact portion; and said first contact portion has a convex portion and said second contact portion has a concave portion.

10. An image forming apparatus according to claim 9, wherein said convex portion is upward and said second contact portion covers said convex portion from above.

11. An image forming apparatus according to claim 9, wherein said convex portion is spherical.

12. An image forming apparatus according to claim 9, wherein said first contact portion is movable to a first position where said image bearing member and said transfer member are contacted, and a second position where said image bearing member and said transfer member are not contacted.

13. An image forming apparatus according to claim 12, wherein said convex portion is provided on a member of which an end is rotatably supported.

14. An image forming apparatus according to claim 9, further comprising a support member for supporting said transfer member, wherein said second contact portion is a part of said support member.

15. An image forming apparatus according to claim 14, wherein said transfer member is a roller and said support member is a bearing.

16. An image forming apparatus comprising:

a voltage applied member to which a voltage is applied; and a first contact portion and a second contact portion which can be mutually contacted for applying a voltage to said voltage applied member;

wherein said voltage applied member is pressed by a pressure exerted between said first contact portion and said second contact portion; and said first contact portion has a convex portion which has a hardness higher than that of said second contact portion.

17. An image forming-apparatus according to claim 16, wherein said convex portion is pressed into said second contact portion to form a concave portion therein.

18. An image forming apparatus according to claim 16, wherein said convex portion is upward and said second contact portion covers said convex portion from above.

19. An image forming apparatus according to claim 16, wherein said convex portion is spherical.

20. An image forming apparatus according to claim 16, wherein a contact portion of said first contact portion and said second contact portion is movable.

21. An image forming apparatus according to claim 20, wherein said convex portion is provided on a member of which an end is rotatably supported.

22. An image forming apparatus according to claim 16, further comprising a support member for supporting said voltage applied member, wherein said second contact portion is a part of said support member.

23. An image forming apparatus according to claim 22, wherein said voltage applied member is a roller and said support member is a bearing.

24. An image forming apparatus comprising:

a voltage applied member; and a first contact portion and a second contact portion which can be mutually contacted for applying a voltage to said voltage applied member;

wherein said voltage applied member is pressed by a pressure exerted between said first contact portion and said second contact portion; and said first contact portion has a convex portion and said second contact portion has a concave portion.

25. An image forming apparatus according to claim 24, wherein said convex portion is upward and said second contact portion covers said convex portion from above.

26. An image forming apparatus according to claim 24, wherein said convex portion is spherical.

27. An image forming apparatus according to claim 26, wherein a contact portion of said first contact portion and said second contact portion is movable.

28. An image forming apparatus according to claim 27, wherein said convex portion is provided on a member of which an end is rotatably supported.

29. An image forming apparatus according to claim 24, further comprising a support member for supporting said voltage applied member, wherein said second contact portion is a part of said support member.

30. An image forming apparatus according to claim 24, wherein said voltage applied member is a roller and said support member is a bearing.

* * * * *

UNITED STATES PATENT AND TRADEMARK OFFICE

CERTIFICATE OF CORRECTION

PATENT NO. : 7,039,337 B2
APPLICATION NO. : 10/779614
DATED : May 2, 2006
INVENTOR(S) : Hiroshi Kawaguchi et al.

It is certified that error appears in the above-identified patent and that said Letters Patent is hereby corrected as shown below:

ON THE TITLE PAGE

At Item (56), Foreign Patent Documents, "JP 58/26544 7/1983" should read --JP 58-126544 7/1983--; "JP 63173078 7/1988" should read --JP 63-173078 7/1998--; "JP 03144474 6/1991" should read --JP 03-144474 6/1991--; "JP 04016882 2/1992" should read --JP 04-16882 2/1992--; and "JP 05027614" should read --JP 05-027614 2/1993--.

COLUMN 2

Line 8, "which" should read --which is--;
Line 58, "Therefore" should read --Therefore,--; and
Line 60, "Also" should read --Also,--.

COLUMN 3

Line 8, "Also" should read --Also,--;
Line 32, "Also" should read --Also,--; and
Line 58, "Therefore" should read --Therefore,--.

COLUMN 7

Line 6, "Also" should read --Also,--; and
Line 44, "Also" should read --Also,--.

COLUMN 9

Line 34, "Also" should read --Also,--;
Line 48, "Also" should read --Also,--; and
Line 61, "Also" should read --Also,--.

COLUMN 10

Line 23, "Also" should read --Also,--;
Line 45, "Therefore" should read --Therefore,--; and
Line 50, "Also" should read --Also,--.

UNITED STATES PATENT AND TRADEMARK OFFICE

CERTIFICATE OF CORRECTION

PATENT NO. : 7,039,337 B2
APPLICATION NO. : 10/779614
DATED : May 2, 2006
INVENTOR(S) : Hiroshi Kawaguchi et al.

It is certified that error appears in the above-identified patent and that said Letters Patent is hereby corrected as shown below:

COLUMN 11

Line 1, "Also" should read --Also,--;
Line 3, "Also" should read --Also,--; and
Line 18, "Also" should read --Also,--.

Signed and Sealed this

Twelfth Day of December, 2006

JON W. DUDAS
*Director of the United States Patent and Trademark Office*